United States Patent [19]

DePietro et al.

[11] Patent Number: 4,860,812

[45] Date of Patent: Aug. 29, 1989

[54] CONNECTING MEANS FOR PARTITION SYSTEMS

[75] Inventors: Mark A. DePietro, Warren; William T. Klim, New Middletown, both of Ohio; Robert H. Ashworth, Pittsburgh; Robert E. Thiele, Wexford, both of Pa.

[73] Assignee: GF Furniture Systems, Inc., Youngstown, Ohio

[21] Appl. No.: 238,495

[22] Filed: Aug. 31, 1988

[51] Int. Cl.[4] ..... A47G 5/00

[52] U.S. Cl. ..... 160/135; 211/189; 52/239

[58] Field of Search ..... 160/135, 351; 211/189; 52/239; 411/539, 533, 522

[56] References Cited

U.S. PATENT DOCUMENTS 4,567,698 2/1986 Morrison ..... 160/135 X 4,601,137 7/1986 Bates ..... 52/239 X

*Primary Examiner*—Blair M. Johnson

*Attorney, Agent, or Firm*—Richard C. Litman

[57] ABSTRACT

A partition system includes connecting tubes having rectangular apertures and cooperating with panels provided with upwardly directed tabs insertable within the apertures for supporting a plurality of the panels. A retention assembly attachable at the top of each tube includes a plate horizontally insertable into slots in two adjacent panels and carrying a vertically adjustable threaded member releasably engageable with the top of the tube to apply a biasing force urging the panel tabs upwardly into the tube apertures to secure the assembly of tubes and panels. The threaded member is subsequently operable in reverse to apply an opposite force between the tube and panels to facilitate separation of the panels from the tube.

10 Claims, 2 Drawing Sheets

CONNECTING MEANS FOR PARTITION SYSTEMS

FIELD OF THE INVENTION

This application relates generally, to partition assemblies and more particularly, to an improved arrangement for connecting a plurality of panels or partitions in either a straight line or angular disposition.

DESCRIPTION OF THE RELATED ART

Partition systems for defining work areas in offices are well known. Such construction includes a plurality of panels having lateral edge channels adapted to cooperate with vertical posts, standards or connecting members serving to support one or more adjacent panels in a free-standing manner with the bottom edges of the panels usually elevated above the underlying floor. Often, the attachment between the panels and standards is accomplished by means of a pair of downwardly directed hook elements on each panel edge channel and which are adapted to engage within horizontal slot or openings formed in the periphery of the standard, usually adjacent the top and bottom of the standards. Retention of the assembled components is frequently assured by the application of a screw cap device applied to the top of the standard and which overlies all panels attached thereto so as to preclude relative vertical displacement between the components which would lead to their separation. Examples of existing partition systems having specific panel-to-post construction elements will be found in the U.S. Pat. Nos. 3,766,692 to Stark et al dated Oct. 23, 1973, 4,104,838 to Hage et al dated Aug. 8, 1978 and 4,567,698 to Morrison dated Feb. 4, 1986.

The Stark et al and Hage et al constructions involve the above mentioned pairs of hook elements on the panel edge channels while Morrison utilizes a clamp device affixed to the top and bottom of the standard and which engage portions of the two adjacent panels.

SUMMARY OF THE INVENTION

By the present invention, an improved arrangement is provided wherein a preferably square, cross-sectioned connecting tube or standard includes a plurality of vertically equi-spaced slots or openings along at least one face thereof and which cooperate with a plurality of similarly spaced and vertically directed tabs extending from the edge channel of each panel to be attached to the connecting tube. A unique point is that the free edges of these tabs are not directed downwardly but rather upwardly such that assembly is accomplished by engaging the tabs within the tube openings and thereafter lowering the connecting tube relative the panels. As a result of this movement, the configuration of the tabs produces a camming effect, insuring a tight juxtaposition between the opposed faces of the involved panel edge channels and tube. The panels and tube are secured and retained in the assembled condition by the application of a novel top plate, serving to prevent relative vertical displacement between the components and which includes displaceable fastener means actually encouraging the camming action between the panel tabs and the tube thereby enhancing the clamping pressure between the juxtaposed surfaces. The panels of the system are supported by the underlying floor such that when cabinets, shelving or the like are attached to the connecting tubes, the weight thereof further increases the interlocking of the tubes to the panels. The same fastening means are subsequently reversibly operated to break apart the positive interlock of the components when it is desired to separate or remove one or more of the panels of a system.

Accordingly, one of the objects of the present invention is to provide an improved connecting structure for partition systems including a tube having apertures along at least one face and receiving upwardly directed tabs projecting from the edge channel of an adjacent panel.

A further object of the present invention is to provide an improved connecting structure for partition systems including a plurality of openings on a tube adapted to receive up to a similar number of angular tabs projecting from the edge of a panel whereby a camming action is produced during assembly of the components, encouraging a tight biasing between the panel and tube.

Still another object of the present invention is to provide an improved connecting structure for partition systems including a tube having three or more equi-spaced openings receiving a similar number of upwardly directed panel tabs and cooperating with a removable top plate having displaceable means operable to urge the panel or panels upwardly relative an attached tube to maintain a tight interconnection therebetween.

With these and other objects in view which will more readily appear as the nature of the invention is better understood, the invention consists in the novel construction, combination and arrangement of parts hereinafter more fully described, illustrated and claimed, with reference be made to the appended drawings.

BRIEF DESCRIPTION OF THE DRAWINGS

Similar reference characters designate corresponding parts throughout the several figures of the drawings.

DESCRIPTION OF THE PREFEERRED EMBODIMENTS

Figure 1:
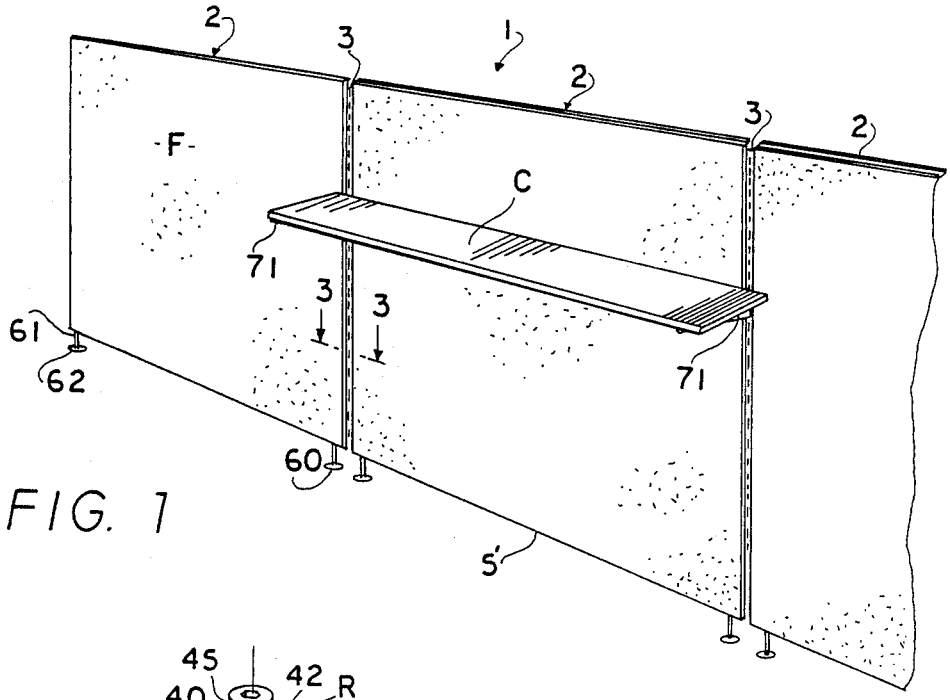
FIG. 1 is a partial front elevation of a straight line partition assembly according to the present invention.

Referring now to the drawings, particularly FIG. 1, the present invention will be seen to relate to a partition system, generally designated 1, and which includes one or more panels 2 adapted to be attached to and rigidly joined together by a connecting tube 3 at each panel end. The depicted arrangement will be understood to define a free-standing assembly wherein the sole interconnection for the panels, whether one or a plurality, comprises the connecting tubes 3. As will be seen hereinafter, the assembly may comprise but a single supported panel 2 or any number of panels connected in an edge to edge manner defining a straight line, an X, right angular, T configuration, or any other angular configuration when viewed in plan.

Figure 2:
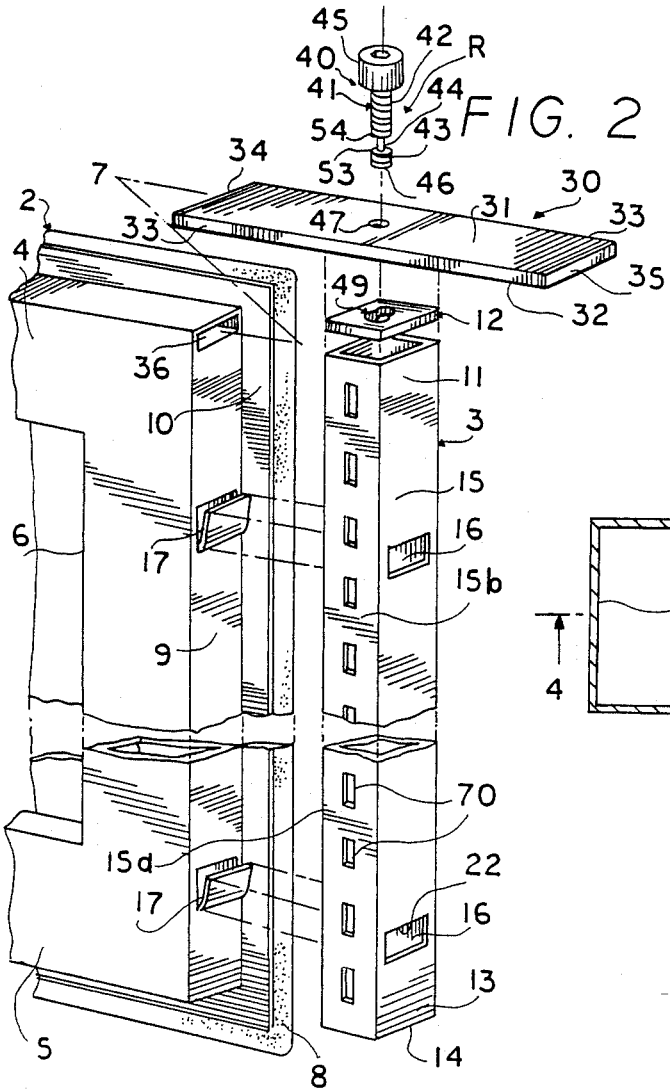
FIG. 2 is an enlarged exploded perspective view illustrating the manner of attachment between a panel and connecting tube.

In any of the above mentioned arrangements, the general concept depicted in the exploded view of FIG. 2 will apply. Each panel 2 includes a rectangular frame defined by a horizontal top channel 4 and bottom channel 5, respectively joined to opposite, vertically disposed edge channels 6. This frame is sandwiched between planar facings 7—7, the latter of which are constructed of any suitable material and may alternatively be covered with fabric F or other materials as is well known in the art. The lateral edges 8 of each facing 7 will be seen to extend beyond the plane of the vertical, base wall 9 of each edge channel 6 to define a recess 10 along the lateral edges of the panels 2.

Each lateral panel edge 9 is adapted to engage and be supported by one of the connecting tubes 3, at least a portion of which is insertable within the panel edge recess 10. The connecting tube preferably comprises an elongated tubular member of square or rectangular stock and of a length substantially comparable to that of the panel edge channels 6. The tubes 3 are hollow and bounded at the upper end 11 by a fixed top wall 12 and project downwardly to a lower end 13, terminating in a bottom edge 14. The opposite tube side walls 15–15*a* are provided with a plurality of equi-spaced, rectangular apertures 16 extending substantially throughout the vertical extent of the tube. In a straight line assembly of two or more panels 2 as in FIGS. 1, 2 and 5 of the drawings, both the first side wall 15 of the tube as well as the opposite, second side wall 15*a* will be understood to be provided with the plurality of apertures 16.

Figure 4:
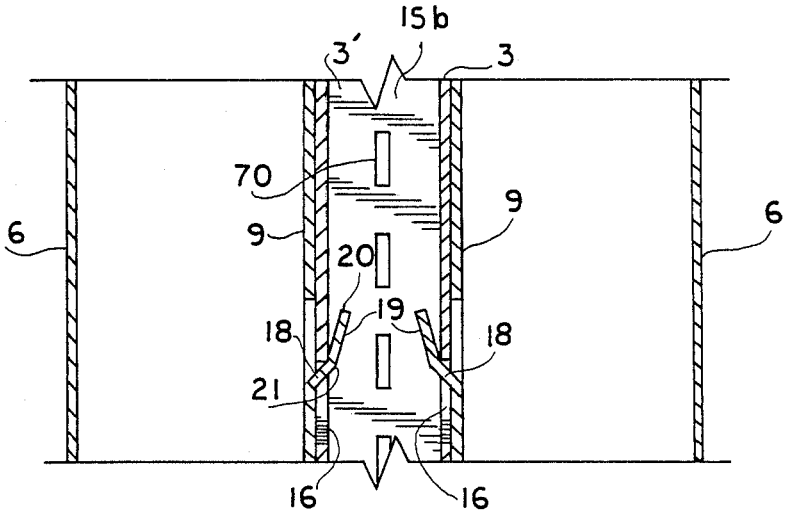
FIG. 4 is a vertical sectional view, taken along the line 4—4 of FIG. 3, illustrating a secured retention assembly of the invention.

To provide the attachment between the panels 2 and tube 3, each panel edge channel base wall 9 includes a plurality of upwardly directed tabs, generally designated 17 which may be most conveniently formed an an integral part of the edge channels 6, such as by punching them from the channel base wall 9. As shown most clearly in FIGS. 2 and 4 of the drawings, each tab includes a base 18 attached to the channel base wall 9 and which extends upwardly and outwardly a relatively short distance before joining with a longer, outer arm 19 which terminates in a horizontal tip 20. The upward inclination of the outer arm 19 is greater than the inclination of the tab base 18 such that a definite bend line 21 or juncture is evident between the two tab elements.

During the joining of a panel 2 to a tube 3, one edge of the panel is fixedly disposed in a manner level with respect to the underlying floor and an apertured side wall 15 or 15*a* of a tube 3 is moved toward the panel edge recess 10 as the opposed tube apertues 16 are guided into a surrounding relationship with respect to the panel tab tips 20. With all the tab tips 20 fully within the interior 3′ of the tube 3, the tube is urged downwardly with respect to the connected panel 2 until the top, horizontal edge 22 of all the apertures 16 firmly abut the inner face 23 of the tabs 17. It will follow that to accommodate this assembly, the vertical extent of the tubes 3 should be no greater than the height of the juxtaposed panel edge and likewise, the positioning of the tube apertures 16 must be such that following assembly, tubes do not project above or below the panels. Since the tubes 3 of the present invention serve to provide the lateral interlock between adjacent panels 2 and not, to support the partition system 1 upon the floor, it is not necessary to have the tubes extend downwardly below the panels for receiving glides or foot members. The inclination of the tab outer arms 19 will be seen to provide a positive guiding force, urging the tube side wall 15 or 15*a* toward the adjacent panel channel base wall 9 and when fully abutting same, throughout the entire length thereof, the juncture between the tube aperture top edges 22 and tube interior 3′ are disposed inwardly of the tab outer arms 19, that is, above the tab base portions 18. Thus, as long as a positive force maintains or urges the panels 2 upwardly relative the attached connecting tube 3, the firm abutment between the juxtaposed tube side wall and channel base wall 9 will be assured.

Normally, in other systems, the weight of cabinets, shelves or other devices that are attached via brackets extending from slotted standards is carried through a top or bottom connector to the panel and subsequently to the floor. In such an environment, if the connector becomes loose or disconnected from the system, the panels will disengage and fall away from each other.

With the subject system, it can be shown that the weight of members attached via brackets 71 extending from slots 70 in the tube outer walls 15*b* is transferred, through tabs 17 and apertures 16, to the panels 2 and subsequently through glide or support assemblies 60 projecting from the panel bottoms 5, to the floor. Weight thus applied to the system acts to drive the connecting devices together automatically and continuously thereby insuring against premature disconnection, as is possible in other known systems.

Figure 5:
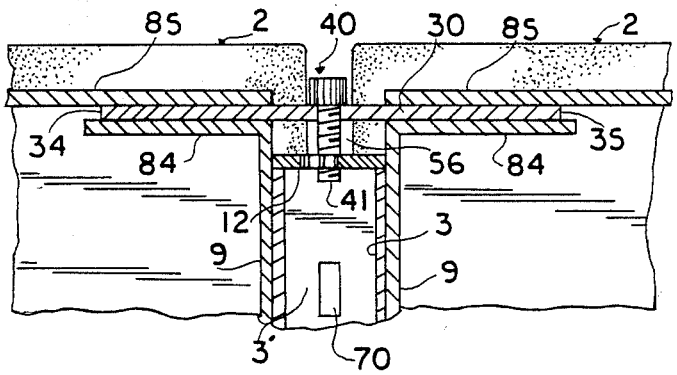
FIG. 5 is a partial vertical sectional view illustrating a secured retention assemlby of the invention.

To retain the panels with respect to one another, before weight is applied to the system, a preloading or alignment mechanism, generally designated R, is employed as shown in FIGS. 2 and 5 and described hereinafter. This mechanism is applied during the the above related attachment between a tube 3 and an adjacent one or more of the panels 2. The alignment mechanism includes an elongated, flat top plate 30 having an upper surface 31 and lower surface 32 bounded by opposite side walls 33—33, a first end wall 34 and a second end wall 35. In the case of a straight line assembly as in FIGS. 1, 2 and 5, the assembly begins by joining the top plate 30 to the tube 3. This is accomplished by use of a releasable lock member 40 comprising a shank 41, divided into an upper threaded section 42, lower threaded section 43 and an intermediate, reduced diameter dowel section 44. An enlarged hand or tool manipulatable head 45 on the top of the lock member permits ready insertion of the lower tip 46 through a tapped bore 47 in the center of the top plate 30 and subsequent rotation of the shank 41 to feed first, the lower threaded section 43 and then, the upper threaded section 42 therethrough. Obviously, the intermediate smaller diameter dowel section will freely pass through the top plate bore 47 without interference.

Figure 2A:
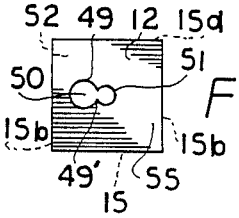
FIG. 2A is an enlarged top plan view of the connecting tube top wall.
Figure 3:
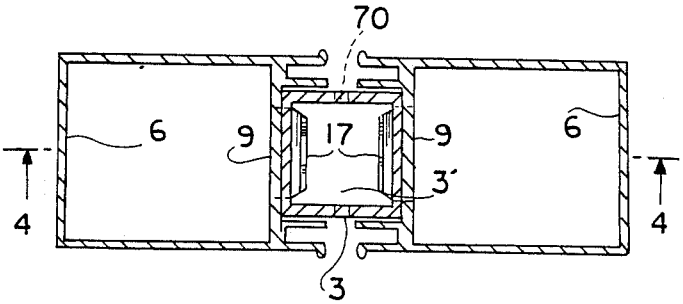
FIG. 3 is a horizontal sectional view, taken along the line 3—3 of FIG. 1 with the panel fabric covering removed for clarity.

Prior to attaching a panel or panels to any one tube 3, the preloading mechanism R is joined to the tube by first, threading the fastener 40 through the bore 47 of the top plate 30 and then, attaching the top plate and its captive fastener as described below. The lock member shank is progressively lowered, as above, until its tip 46 reaches or engages the top wall 12 of the connecting tube 3. This tube top wall will be seen from FIGS. 2, 2A and 5 to be provided with a smooth-walled keyhole opening 49 having a large diameter passageway 50 communicating with an adjacent small diameter passageway 51, the latter of which is preferably centrally disposed with respect to the lateral dimensions of the tube top wall 12. When the shank tip abuts the tube top wall 12, the lock member 40 and its attached top plate 30 are shifted laterally until the tip 46 is vertically aligned above the large keyhole passageway 50. The diameter of this passageway will be understood to be slightly greater than that of the threaded portions of the lock member shank 41 so that the lock member may be moved downwardly or further rotated through the top plate to lower its shank until the lower threaded section 43 is fully disposed beneath the undersurface 52 of the tube top wall 12. In this position it will be seen that only the intermediate dowel section 44 of the lock member shank is located within the confines of the tube top wall keyhole opening 49 such that a simple lateral shifting of the entire lock member and top plate sub-assembly will position the shank dowel section 44 within the keyhole small diameter passageway 51. The radial dimensions of this passageway are such that a close fit is provided for the shank dowel section 44 while vertical displacement therebetween, either upwardly or downwardly, is precluded due to the overlying shoulders 53, 54 respectively, of the lower and upper shank threaded sections.

The common axis biasecting the two keyhole passageways 50,51 will be seen to be disposed parallel to the face of the panel channel base walls 9 and tube side walls **15,15*a*. Additionally, the circumference of the smaller diameter passageway 51 will be understood to be greater than 180 degrees, such than a definite bite 49' is defined between the two keyhole passageways, to insure captive retention of the fastener shank when located with the dowel section 44 within the passageway 51**.

During the above initial assembly of the alignment mechanism R relative the tube 3, the fastener 40 is manipulated so that the tube top wall 12 will be positioned relative close to the undersurface 32 of the top plate 30.

With the components arranged as above described, the panels 2,2 are disposed level with respect to the underlying floor and are moved laterally, toward one another, with the tube assembly therebetween. The respective ends 34,35 of the top plate 30 are guided into the slots 36 in the base walls 9 of the two panel edge channels 6,6 and as the side walls **15,15*a* of the tube approach the panel channel base walls 9,9, the plurality of tabs 17 enter the tube apertures 16. With the tube 3 flushly sandwiched between the adjacent panels 2, the fastener 40 is manipulated in a clockwise direction thereby advancing its shank downwardly. Since the shank is captive relative the tube top wall 12 it will follow that this manipulation will force the entire tube 3 downwardly or away from the top plate 30 and this motion will lower all the tube apertures 16 with respect to the contained panel tabs 17 or, into the position as shown most clearly in FIG. 4** of the drawings.

With the foregoing operation in mind, it will be appreciated that a positive, interlock between adjacent panels and the intermediate tube is provided and this interlock is not dependent upon supplemental underlying support elements for either the panels or tube. To enhance the horizontal alignment between the joined panels during the installation procedure, the interior of the panel frame top channels 4 may include a support or guide member 84, spaced from the panel frame top wall 85 to provide a close sliding fit of the top plate ends 34,35 when inserted through the panel slots 36.

Accordingly, an extremely positive interlocking will be achieved by the above described construction and which serves to preload the system and maintain rigidity in the system until subsequent weight is added from cabinets or the like C attached to the outside surfaces **15*b* of the tubes by the brackets 71. Since the panels are supported by the underlying floor, such as through support assemblies or glides 60, it will be seen that this later applied weight serves to drive the tubes 3 into an even greater locking engagement relative the panels 2—2** thus making the attachment all the more rigid. As previously mentioned, many prior assemblies rely upon the weight of the panels to urge hook members on the panels to engage receptacles on cooperating support tubes, an arrangement totally unlike that being described herein.

Another feature of the present preloading assembly R is that when it is desired to disconnect the attachment of any panel 2 from its associated connecting tube 3, the previously applied wedging action of the tube aperture top edges 22 into the bit between the plurality of tabs 17 and panel channel wall 9 is easily broken loose by the very same lock member 40. This is accomplished by reversing the direction of rotation of the fastener 40 so as to raise or unscrew the shank 41. With the shank upper portion 42 remaining engaged with the tapper bore 47 of the vertically fixed top plate 30, it will follow that unscrewing of the lock member 45 will raise the shank 41 whereupon, the shank shoulder 53 will engage the tube top wall's undersurface 52, thereby applying a lifting force to the entire tube 3 while the top plate retains the panels vertically immobile. Following the breaking of any binding action between the previously locked together tube and panels, the lock member 45 is easily fully removed by a reversal of the installation procedure, namely by laterally shifting the panels to remove their tabs 17 from the tube apertures 17. Subsequently, the top plate and its joined lock member 40 may be separated from the tube top wall 12 by moving the shank lower section 43 forwardly so that fastener may be lifted upwardly through the tube top wall's larger diameter passageway 50. To facilitate the above tightening and releasing action, a vertical clearance 56 is provided between the tube top wall 12 and top plate 30, as shown in FIG. 5 of the drawings, to allow for vertical displacement of the tube 3 from its tightened position to a released position, before abutment with the relative stationary top plate 30.

A plurality of panels interconnected as described above are most conveniently maintained in an erect position, with the panel bottom edges 5' spaced above the underlying floor, by means of the support or glide assemblies 60 removably affixed to each panel bottom channel 5 adjacent its two edge channels 6—6. A suitable support assembly includes a screw shank 61 having a foot or glide element 62 carried at its lower end and whereby the upper end may be threadedly engaged in a tapped bore within the panel bottom channel 5. With this construction, vertical adjustment of the shank 61 permits accommodating unevenness of the underlying floor to achieve a stable assembly of a plurality of interconnected panels.

In a partition assembly consisting of panels disposed in a straight line or in the case of an endmost connecting tube in any configuration, the outermost side walls 15 or **15*a* of that connecting tube may be imperforate if desired since these outer tube walls serve no function in providing a connection with an adjacent panel. Preferably though, the front and rear or outer walls 15*b*—15*b* are provided with the same plurality of vertically extending equispaced slots 70 as the remaining, intermediate tubes, for the selective insertion of any of a number of well known bracket members such as the illustrated shelf supports 71. An optional member may comprise a tube cover strip (not shown) which may be applied to mask the otherwise exposed outer faces 15*b*—15*b*** of an intermediate or endmost connecting tube.

In a system wherein two adjacent panels 2 are disposed in a straight line manner as shown in FIG. 1, the inserted top plate 30 firmly engages the two panels and is vertically immobile with respect thereto, in view of the top bar ends 34–35 being disposed through the slots 36 in the top of the two opposed panel edge channels. This action is assured due to the balanced or symmetrical assembly. On the other hand, alternate structure is called for when other system configurations are involved.

Figure 6A:
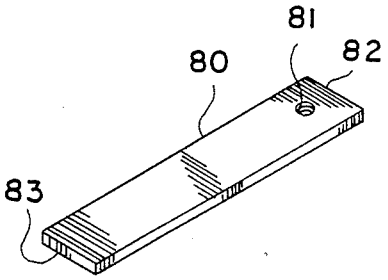
FIGS. 6A–6D are perspective views of alternate top plates employed with connecting tubes in other than intermediate two straight line panels.
Figure 7A:
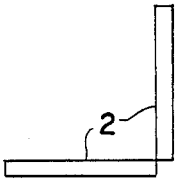
FIGS. 7A–7C are plan views diagramatically illustrating panel arrangements other than straight line assemblies.
Figure 7B:
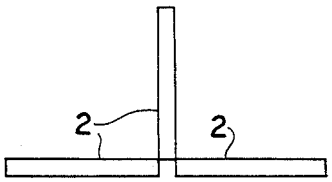
Figure 7C:
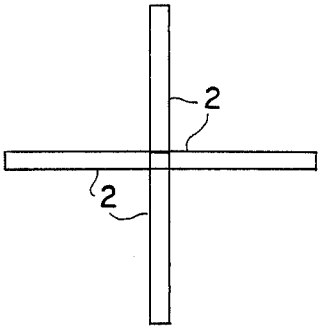

In the case of a connecting tube 3 supporting the free lateral edge of an endmost panel in a partition system, a modified top plate 80 as shown in FIG. 6A is used and which is shorter than the top plate 30. The plate 80 is provided with a tapped bore 81 near one end 82 and which cooperates with the same lock member 40 as described above. In use of this latter plate, the end 83 is inserted into the sole available slot 36 of the endmost panel whereafter the cooperating lock member 40 is manipulated as before. In such a situation the single panel frame involved will require the support or guide plate 84 shown in FIG. 5 to insure that the top plate 80 provides a vertically stable cantilevered member.

Figure 6B:
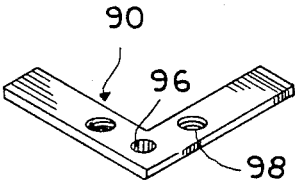
Figure 6C:
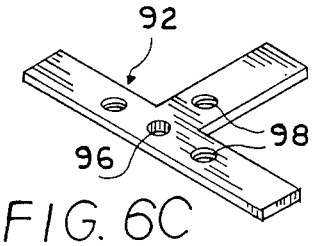
Figure 6D:
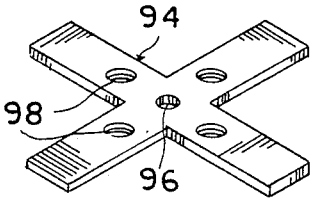

The embodiments illustrated in FIGS. 6B–6D depict top plates 90,92,94 utilized for partition systems involving respectively, right-angle, T and X joined panels 2. In each instance, a central bore 96 is provided for the attachment of a tube-joining member (not shown) while the respective arms or legs of each top plate include a tapped bore 98 adapted to receive the fastener 40 of a preloading assembly R as above described. Thus, it will be seen that any of variously configured partition systems may be provided according to the present invention, all utilizing the unique connection or interlock structure herein described.

We claim:

1. A partition system including:

a plurality of panels each having top and bottom channels and opposite edge channels, said panel edge channels including a slot adjacent said top channels, a plurality of tabs projecting outwardly from said edge channels, a connecting tube having a top and a bottom for joining said panels by engagement with said edge channels, a top wall on said connecting tube and having a passageway therethrough, said connecting tube having a plurality of apertures adapted to receive said tabs, an alignment assembly attached adjacent the top of said panels and overlying said top of said tube, said alignment assembly including a top plate carrying releasable lock means operable to apply a vertical biasing force in one direction against said tube while concurrently applying a vertical biasing force in an opposite direction against said panels to forcefully retain said panel tabs within said tube apertures, said top plate having opposite ends respectively inserted within opposed ones of said edge channel slots of adjacent pairs of said panels, and said releasable lock means including a threaded fastener having a shank provided with alternate portions selectively engageable with said tube top wall, whereby manipulation of said threaded fastener in opposite directions alternately displaces said tube away from and toward said top plate.

2. A partition assembly according to claim 1 wherein, said connecting tube is rectangular in cross section.

3. A partition assembly according to claim 1 including, a pair of oppositely disposed side walls on said tube, and said apertures formed in said side walls.

4. A partition assembly according to claim 1 including, support means extending from said panel bottom channel adapted to engage an underlying floor, whereby said connecting tube bottom is clear of engagement with an underlying floor.

5. A partition assembly according to claim 1 wherein, said connecting tube includes a plurality of slots adjacent said apertures, and bracket means mounted within at least one said tube slots adapted to support a shelf or the like.

6. A partition assembly according to claim 1 including, a plurality of said connecting tubes and adjacent ones of said panels, and said panels disposed in a straight line.

7. A partition assembly according to claim 1 including, a plurality of said connecting tubes and adjacent ones of said panels, and said panels disposed in a right angular configuration.

8. A partition assembly according to claim 1 including, a plurality of said connecting tubes and adjacent ones of said panels, and said panels disposed in a T configuration.

9. A partition assembly according to claim 1 including, a plurality of said connecting tubes and adjacent ones of said panels, and said panels disposed in an X configuration.

10. A partition system including;

a plurality of panels each having top and bottom channels and opposite edge channels, a plurality of tabs projecting outwardly from said edge channels, a connecting tube having a top and a bottom for joining said panels by engagement with said edge channels, a top wall on said connecting tube and having a passageway therethrough, said passageway comprising a keyhole having adjacent large and small diameter openings, said connecting tube having a plurality of apertures adapted to receive said tabs, an alignment assembly attached adjacent the top of said panels and overlying said top of said tube, said alignment assembly including a top plate carrying releasable lock means operable to apply a vertical biasing force in one direction against said tube while concurrently applying a vertical biasing force in an opposite direction against said panels to forcefully retain said panel tabs within said tube apertures, said releasable lock means including a threaded fastener having a shank provided with alternate portions selectively engageable with said tube top wall, said threaded fastener shank including an intermediate reduced diameter portion and said shank alternate portions including larger diameter portions bounding said reduced diameter portions, whereby said larger diameter portions are freely insertable through said keyhole large diameter opening while only said reduced diameter portion is insertable through said keyhole small diameter opening with manipulation of said threaded fastener in opposite directions while said reduced diameter portion is within said keyhole small diameter portion alternately displacing said tube away from and toward said top plate.

* * * * *